US007874881B1

(12) United States Patent
Sosa et al.

(10) Patent No.: US 7,874,881 B1
(45) Date of Patent: Jan. 25, 2011

(54) FULL TENSION SWAGED CONNECTOR

(75) Inventors: Luis Sosa, Los Angeles, CA (US); Robert Hobbs, Los Angeles, CA (US); Bruce Young, Westminster, CA (US)

(73) Assignee: Designed Metal Connections, Inc., Gardena, CA (US)

( * ) Notice: Subject to any disclaimer, the term of this patent is extended or adjusted under 35 U.S.C. 154(b) by 0 days.

(21) Appl. No.: 12/541,440

(22) Filed: Aug. 14, 2009

(51) Int. Cl.
*H01R 4/10* (2006.01)

(52) U.S. Cl. ..... 439/877

(58) Field of Classification Search ..... 439/877, 439/880, 882; 174/84 C
See application file for complete search history.

(56) References Cited

U.S. PATENT DOCUMENTS

| | | | |
|---|---|---|---|
| 1,909,344 | A | 5/1933 | Green et al. |
| 2,188,178 | A | 1/1940 | Eby |
| 2,799,721 | A | 7/1957 | Floyd, Jr. |
| 2,958,723 | A | 11/1960 | Logan et al. |
| 3,033,600 | A | 5/1962 | Drysdale |
| 3,052,750 | A | 9/1962 | Cobaugh |
| 3,184,535 | A | 5/1965 | Worthington |
| 3,976,385 | A | 8/1976 | Klopfer |
| 4,681,382 | A | 7/1987 | Lockard |
| 4,817,682 | A | 4/1989 | Williams |
| 4,829,146 | A | 5/1989 | Duve |
| 5,069,058 | A | 12/1991 | Hyatt |
| 5,516,158 | A | 5/1996 | Watts |
| 5,600,096 | A | 2/1997 | Cherry et al. |
| 5,654,527 | A | 8/1997 | Ciobanu et al. |
| 5,821,463 | A | 10/1998 | Ngo |
| 6,165,004 | A | 12/2000 | Robinson |
| 6,734,359 | B2 | 5/2004 | Hanazaki et al. |
| 7,049,520 | B1 | 5/2006 | Tamm et al. |
| 7,299,674 | B2 | 11/2007 | Palejwala et al. |
| 7,311,553 | B2 | 12/2007 | Tamm |
| 7,337,514 | B2 | 3/2008 | McKay |

OTHER PUBLICATIONS

Tension Splicers, The Homac Companies, data sheets, pp. 101-102.
Transmission Connectors, Hubbell Power Systems, Inc., data sheets, Section TC, (Nov. 2008), pp. TC-4-TC-5.
Transmission Connectors, Hubbell Power Systems, Inc., data sheets, Section TA, (Apr. 2008), pp. TA-13-TA-14.

*Primary Examiner*—Kheim Nguyen
(74) *Attorney, Agent, or Firm*—Blakely, Sokoloff, Taylor & Zafman LLP

(57) ABSTRACT

An improved full tension connector for electrical conductors has a substantially cylindrical outer surface and a stepped series of substantially cylindrical inner surfaces with progressively smaller inside diameters. The design of the connector allows for improved control of the compression of the cable inside the fitting. A series of swages, progressing successively from a light compression to a heavier compression, ensures that the connector will sustain the required tensile load.

9 Claims, 1 Drawing Sheet

FULL TENSION SWAGED CONNECTOR

BACKGROUND OF THE INVENTION

1. Field of the Invention

This invention relates to the field of power transmission and, more particularly, to connectors for high tension power transmission lines.

2. Background

Connectors play a critical role in the efficiency and reliability of power transmission systems. Aluminum cables used for overhead transmission lines require connectors for splices and dead end assemblies. Currently available connectors are typically tubular aluminum devices that are crimped or swaged onto the cable. In order to achieve a full or nearly full tension fitting, prior art connectors require numerous crimps or swages and are therefore relatively long and heavy. In addition, the installation tools for prior art connectors are large and unwieldy. During the installation of prior art connectors, the length of the fitting and the size of the tooling may result in undesired bending of the connector.

SUMMARY OF INVENTION

The present invention provides an improved connector with a body having a substantially cylindrical outer surface and a stepped series of substantially cylindrical inner surfaces with progressively smaller inside diameters. The design of the connector allows for improved control of the compression of the cable inside the fitting. A series of swages, progressing successively from a light compression to a heavier compression, ensures that the connector will sustain the required tensile load.

In comparison to prior art connectors, the present invention provides a smaller, lighter full tension connector that can be installed with fewer swages. Installation of the connector is quicker and easier than prior art counterparts. Furthermore, the connector is less prone to bending during installation.

DETAILED DESCRIPTION OF THE INVENTION

Figure 1:
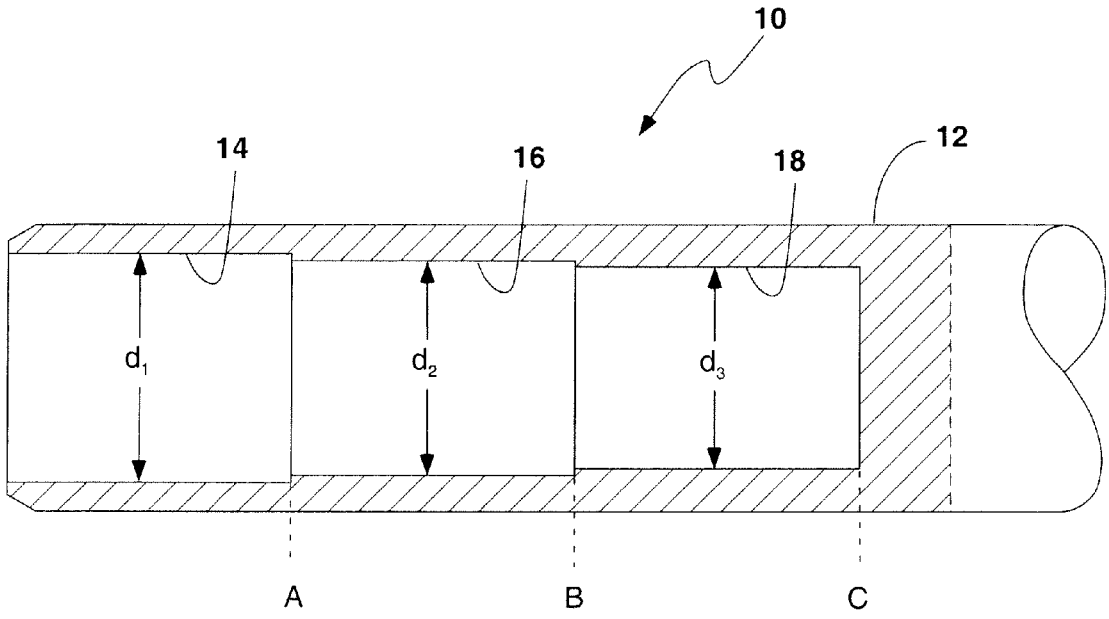
FIG. 1 is a partial cross-sectional view of a connector in accordance with an embodiment of the present invention.

In the following description, for purposes of explanation and not limitation, specific details are set forth in order to provide a thorough understanding of the present invention. However, it will be apparent to one skilled in the art that the present invention may be practiced in other embodiments that depart from these specific details. In other instances, detailed descriptions of well-known methods and devices are omitted so as to not obscure the description of the present invention with unnecessary detail.

A connector 10 in accordance with one embodiment of the present invention is shown in FIG. 1. The connector body 12 has a substantially cylindrical outer surface. A first substantially cylindrical inner surface 14 has an inside diameter $d_1$ and extends axially from the end of connector body 12 to a depth A. A second substantially cylindrical inner surface 16 has an inside diameter $d_2$, which is smaller than $d_1$, and extends axially from depth A to depth B. A third substantially cylindrical inner surface 18 has an inside diameter $d_3$, which is smaller than $d_2$, and extends axially from depth B to depth C.

To install the connector 10 onto a cable, the end of the cable is inserted into the connector body to depth C. The connector is compressed onto the cable using a hydraulic swaging tool. A suitable swaging tool may be, for example, the tool disclosed in U.S. Pat. No. 7,299,674 and commercially available under the CableLok® brand from Designed Metal Connections of Gardena, Calif. The design of connector 10 allows it to be installed on the cable using a single die set.

The first swage area at the end of the connector (i.e., between the end of the connector body where the cable is inserted and depth A) carries the maximum load. This has the minimum compression, thereby minimizing damage to the cable. The second swage area (i.e., between depth A and depth B) holds the load that the first swage area cannot take and has a heavier compression to provide better electrical contact. The third swage area (i.e., between depth B and depth C) carries less load, but provides the best electrical contact. When properly installed, connector 10 can sustain a load of 95% or more of the rated strength of the cable, thereby meeting the requirements for class 1 full tension fittings of the C119.4 ANSI standard.

As will be appreciated, the specific dimensions of connector 10 are dependent upon the dimensions of the cable with which it will be used. The smallest inside diameter, in this case $d_3$, is slightly greater than the nominal outside diameter of the cable. The inside diameter step sizes (i.e., the difference between $d_1$ and $d_2$ and the difference between $d_2$ and $d_3$) may be less than about 0.05 inches. The axial length of each step (i.e., the distance from the end of the connector body to depth A, from depth A to depth B, and from depth B to depth C) is determined primarily by the dimensions of the swaging tool head and may be approximately 1 inch. Connector 10 has been described as having three swaging segments; however, it is to be understood that other embodiments of the invention may have more or fewer segments.

Connector 10 may be configured either as a splice connector with a tubular body receiving a cable at each end or as a full tension dead end having a suitable structural coupling. In one embodiment, connector 10 is fabricated with 6061-T6 aluminum alloy, although other alloys may be used. In this embodiment, the connector body is heat treated (annealed) after machining.

It will be recognized that the above-described invention may be embodied in other specific forms without departing from the spirit or essential characteristics of the disclosure. Thus, it is understood that the invention is not to be limited by the foregoing illustrative details, but rather is to be defined by the appended claims.

What is claimed is:

1. A connector for an electrical conductor comprising:

a body having a substantially cylindrical outer surface;

a first substantially cylindrical inner surface having a first inside diameter $d_1$, the first inner surface extending axially from a first end of the body to a depth A;

a second substantially cylindrical inner surface having a second inside diameter $d_2$ smaller than $d_1$, the second inner surface extending axially from the depth A to a depth B;

wherein $d_1-d_2<0.05$".

2. The connector of claim 1 further comprising a third substantially cylindrical inner surface having a third inside diameter $d_3$ smaller than $d_2$, the third inner surface extending axially from the depth B to a depth C;

wherein $d_2-d_3<0.05$".

3. The connector of claim 2 further comprising a fourth substantially cylindrical inner surface having a fourth inside diameter $d_4$ smaller than $d_3$, the fourth inner surface extending axially from the depth C to a depth D;

wherein $d_3-d_4<0.05"$.

4. The connector of claim 1 wherein the body is configured as a splice.

5. The connector of claim 1 wherein the body is configured as a dead end.

6. A method of attaching the connector of claim 1 to an electrical conductor comprising:

inserting an electrical conductor into the connector to at least depth B;

compressing the outer surface of the connector between the first end and depth A with a first compression force;

compressing the outer surface of the connector between depth A and depth B with a second compression force greater than the first compression force.

7. A method of attaching the connector of claim 2 comprising:

inserting an electrical conductor into the connector to at least depth B;

compressing the outer surface of the connector between the first end and depth A with a first compression force;

compressing the outer surface of the connector between depth A and depth B with a second compression force greater than the first compression force; and compressing the outer surface of the connector between depth B and depth C with a third compression force greater than the second compression force.

8. The method of claim 6 wherein the steps of compressing are performed using a swaging tool.

9. The method of claim 7 wherein the steps of compressing are perforated using a swaging tool.

* * * * *

UNITED STATES PATENT AND TRADEMARK OFFICE

CERTIFICATE OF CORRECTION

PATENT NO. : 7,874,881 B1
APPLICATION NO. : 12/541440
DATED : January 25, 2011
INVENTOR(S) : Luis Sosa et al.

It is certified that error appears in the above-identified patent and that said Letters Patent is hereby corrected as shown below:

Column 4, Claim 9, line 16, delete "perforated" insert -- performed --

Signed and Sealed this
Third Day of May, 2011

David J. Kappos

David J. Kappos
*Director of the United States Patent and Trademark Office*